US010849440B2

(12) United States Patent
Pérez Sanchez

(10) Patent No.: US 10,849,440 B2
(45) Date of Patent: Dec. 1, 2020

(54) T-SHIRT

(71) Applicant: Quokkababy C.B., Madrid (ES)

(72) Inventor: Beatriz Pérez Sanchez, Madrid (ES)

(73) Assignee: QUOKKABABY C.B., Madrid (ES)

( * ) Notice: Subject to any disclaimer, the term of this patent is extended or adjusted under 35 U.S.C. 154(b) by 94 days.

(21) Appl. No.: 16/150,634

(22) Filed: Oct. 3, 2018

(65) Prior Publication Data

US 2019/0216231 A1 Jul. 18, 2019

(30) Foreign Application Priority Data

Aug. 3, 2017 (ES) ..... 201730941

(51) Int. Cl.

| | |
|---|---|
| ***A47D 13/02*** | (2006.01) |
| ***A41D 1/04*** | (2006.01) |
| ***A41B 1/00*** | (2006.01) |
| *A41D 1/215* | (2018.01) |

(52) U.S. Cl.

CPC ..... *A47D 13/025* (2013.01); *A41B 1/00* (2013.01); *A41D 1/04* (2013.01); *A41D 1/215* (2018.01); *A41D 2400/482* (2013.01); *A41D 2400/52* (2013.01)

(58) Field of Classification Search

CPC .. A41B 1/00; A41B 1/04; A41B 1/205; A41D 1/04; A47D 13/025

USPC ..... 2/69

See application file for complete search history.

(56) References Cited

U.S. PATENT DOCUMENTS

| | | | | |
|---|---|---|---|---|
| 4,144,593 | A * | 3/1979 | Timmons | A41D 1/215 2/104 |
| 4,277,848 | A * | 7/1981 | Boehland | A41D 1/04 2/115 |
| 4,697,287 | A * | 10/1987 | Rose | A41D 1/215 2/48 |
| 5,008,960 | A * | 4/1991 | Hemming | A41D 1/215 2/104 |
| 6,327,712 | B1 * | 12/2001 | Armstrong | A41D 1/215 2/104 |
| 6,820,281 | B2 * | 11/2004 | Mariland | A41D 27/20 2/115 |
| 2018/0064180 | A1 * | 3/2018 | Dickson | A41D 1/215 |

* cited by examiner

*Primary Examiner* — Timothy K Trieu
(74) *Attorney, Agent, or Firm* — Ladas & Parry LLP

(57) ABSTRACT

A baby carrier T-shirt comprises a front part (12) and a rear part (51) arranged to form the body of the T-shirt (11); wherein the T-shirt comprises a first vertical strap (13) and a second vertical strap (14) arranged along the front part of the T-shirt (12) and joined to the T-shirt (11) from the area of the shoulders towards the lower end of the T-shirt (11); and a frontal vertical layer (15) arranged along the front part (12) and below the first and second strap (12, 13); the frontal vertical layer (15) being joined to the T-shirt by both vertical ends of the area of the chest of the T-shirt (11). The vertical frontal layer is removable by at least one upper end so that a removable joining zone is defined at a first outer edge of the upper portion of the T-shirt and at a second outer edge opposite the first edge, by sewing technique forms an outer edge seam, which can be gathered.

6 Claims, 6 Drawing Sheets

T-SHIRT

OBJECT

The present invention relates to a baby carrier T-shirt for carrying babies securely and ergonomically skin to skin.

PRIOR ART

The use of garments to carry babies weighing up to 8 kg is known, comprising two layers of fabric crossed in the shape of an X, in the centre of which the baby is arranged in a seated position, the legs of the baby going out through the laterals of the two layers of crossed fabric and a third layer of horizontal fabric adjusted in the exterior part of the T-shirt, below the crossing point of the two layers of crossed fabric which retains the baby in a vertical position to exert a pressure on the abdominal area of the carrier of the baby, in the manner of an abdominal strap.

A disadvantage of the baby carrier device is that it is not universal; that is to say, each carrier should use a baby carrier device for their size since, otherwise, the third layer of fabric would exert zero or excess pressure on the abdominal area of the carrier.

In addition, attention must be paid when placing the baby in the crossing area of the two layers of crossed fabric since if the carrier makes periodic and continuous movements, the baby is displaced out of the optimal vertical position situated in the cross of the two layers of fabric, the legs of the baby remaining downwards, resulting in an incorrect placement of the baby and the device losing its ergonomy.

Consequently, there is a need to develop an ergonomic baby carrier device which ensures a correct position of the carried baby when periodic and continuous movements are carried out.

SUMMARY

The present invention aims to resolve one or more of the drawbacks outlined above by means of a baby carrier T-shirt as is defined in the claims.

A baby carrier T-shirt comprises a front part and a rear part arranged to form the body of the T-shirt; a first vertical strap and a second vertical strap arranged along the front part of the T-shirt and joined to the T-shirt by the area of the shoulders towards the lower end of the T-shirt; and a vertical frontal layer arranged along the front part and below the first and second strap; the vertical frontal layer being joined to the T-shirt by the laterals of the area of the chest of the T-shirt.

The vertical frontal layer has a free lower end configured to form an interior seat by means of folding the free lower end towards the interior so that the folded lower end itself enters into physical contact with the front part of the T-shirt. The vertical frontal layer has a U tongue shape.

The interior seat is configured so that the thighs and buttocks of the baby are in physical contact with the interior seat itself such that the hips of the baby adopt an M shape.

The first vertical strap and the second vertical strap are configured to be joined to the T-shirt by a lateral seam, respectively, which is developed along the area of the shoulder and sleeves of the T-shirt itself, presenting an L shape.

The vertical frontal layer is configured to be joined to the T-shirt by means of a sewing technique, forming two seams of exterior edges, being able to be gathered which are developed from the area of the chest of the T-shirt below and above the underarms of the carrier, towards the lower end of the T-shirt itself.

The rear part comprises a reinforcement device in an X, U shape; the reinforcement device being configured to be joined to the rear part of the T-shirt along the area of the shoulders and below the underarms.

The reinforcement device is adapted to help to maintain the spinal column of the carrier in a C posture.

The first vertical strap and the second vertical strap are configured to be crossed below the interior seat formed and tied along the rear part of the T-shirt.

The height of the interior seat is secured by means of the crossing of the first vertical strap and the second vertical strap below the seat itself; that is to say, the crossing of the first and second vertical straps is arranged to maintain the hips of the carried baby in the M position. The vertical straps are knotted in the rear part of the T-shirt.

The rear part comprises a reinforcement arrangement in an X, U shape; the reinforcement device being joined in the area of the shoulders and below the underarms to the rear part of the T-shirt. The function of the reinforcement device is to help to maintain the spinal column of the baby in a C posture; lumbar curvature. The lumbar curvature of the back of the carrier is a double S.

The function of the reinforcement arrangement is to distribute the weight of the baby to ensure the comfort of the carrier and maintain the C posture of the lumbar curvature of the back of the baby, preventing the fabric of the seat falling downwards due to the baby's own weight: when it is arranged in the seat.

The lumbar curvature of the carrier has a double S shape.

Alternatively, the vertical frontal layer is configured to be removable by at least one upper, end so that a removable joining zone is defined at a first outer edge of the upper portion of the T-shirt and at a second outer edge opposite the first edge, by sewing technique forms an outer edge seam, which can be gathered. Both the removable area and the outer edge seam are arranged in the chest area of the T-shirt, below and above the armpits of the carrier, towards the lower end of the T-shirt itself.

BRIEF DESCRIPTION OF THE DRAWINGS

A more detailed explanation is given in the description which follows and which is based on the attached figures.

DESCRIPTION

Figure 1:
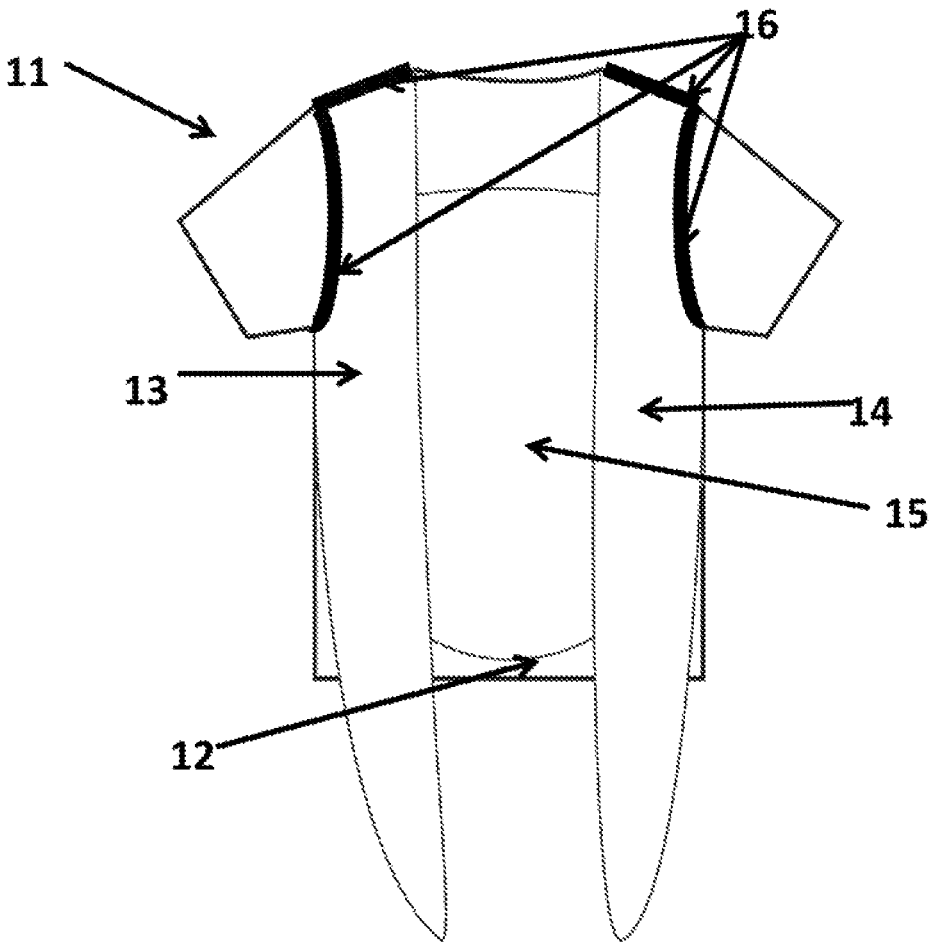
FIG. 1 shows, in an elevation view, the front part of a baby carrier T-shirt and a first vertical strap and a second vertical strap joined to the baby carrier T-shirt by means of a lateral seam, being a line broken which has an L shape.
Figure 2:
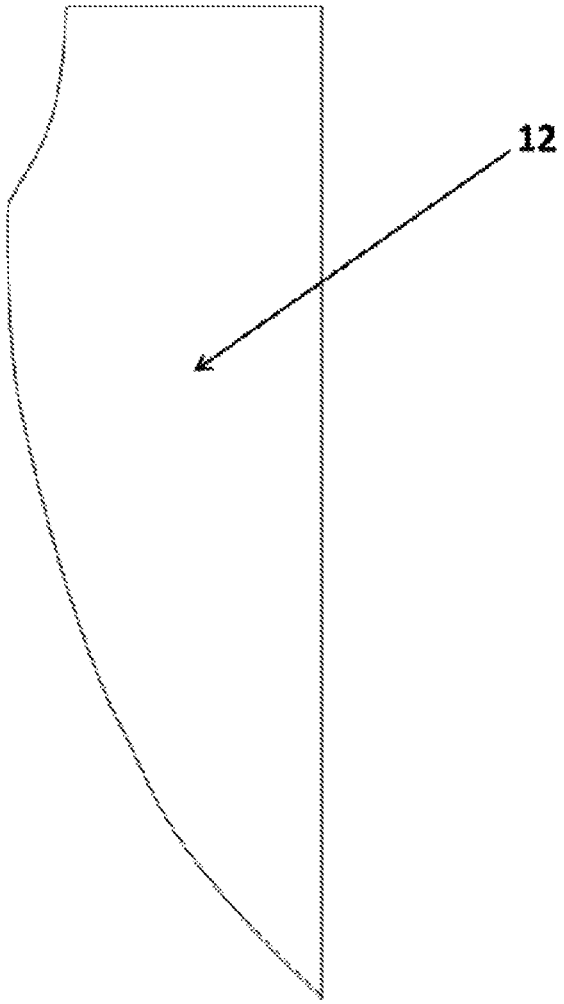
FIG. 2 shows, in an elevation view, the first vertical strap.
Figure 3:
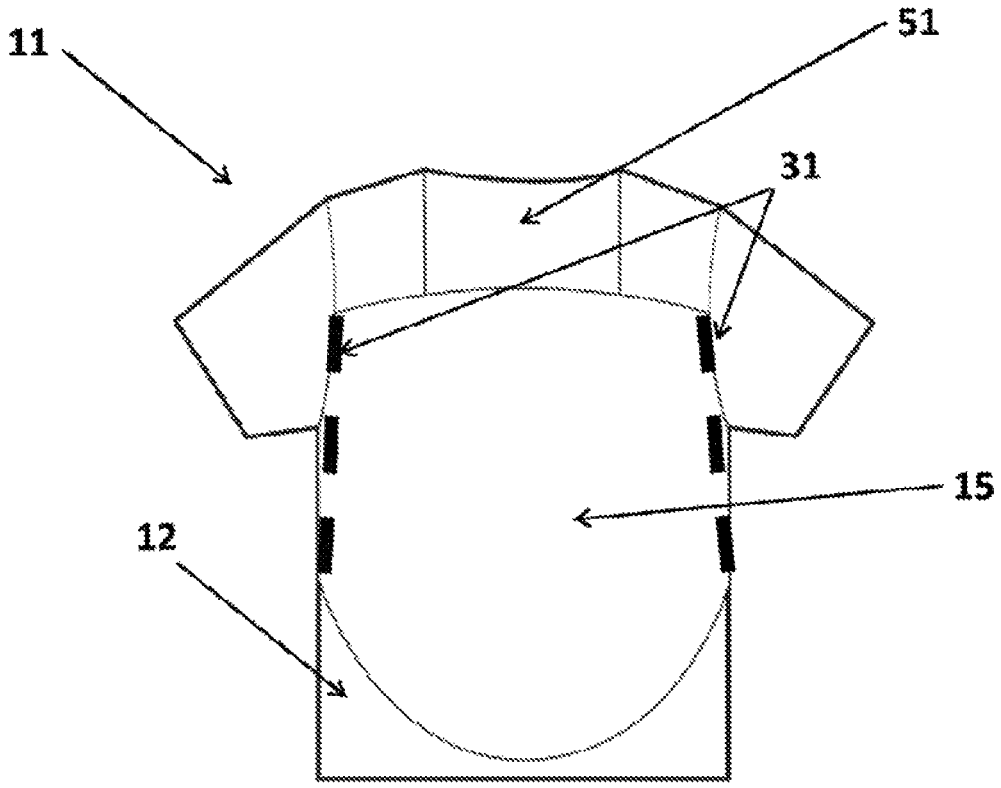
FIG. 3 shows, in an elevation view, the front part of the baby carrier T-shirt without the first vertical strap and the second vertical strap to show a vertical frontal layer with a tongue shape joined by means of seams at the exterior edge to the front part of the T-shirt.
Figure 4:
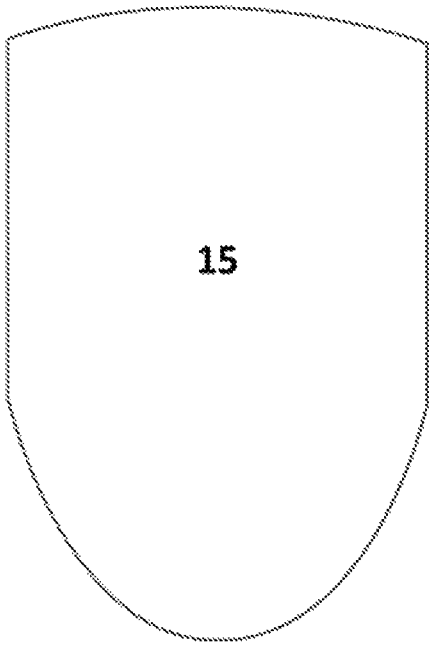
FIG. 4 shows, in an elevation view, the vertical frontal layer.
Figure 5:
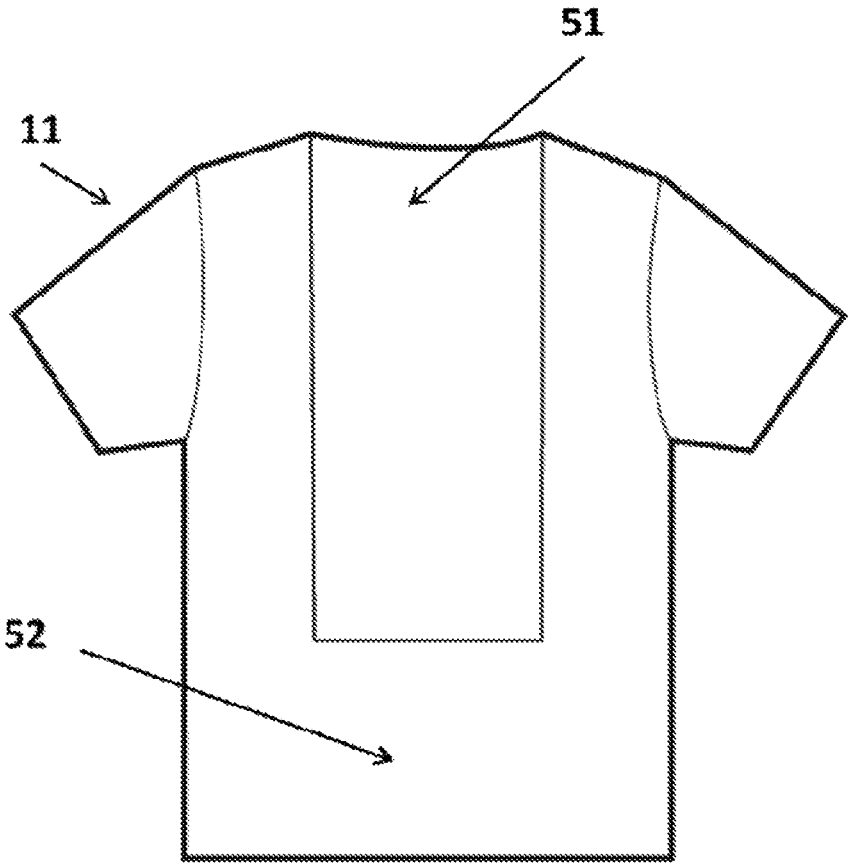
FIGS. 5 and 6 show, in an elevation view, the rear part of the baby carrier T-shirt including different alternatives of a reinforcement device.
Figure 6:
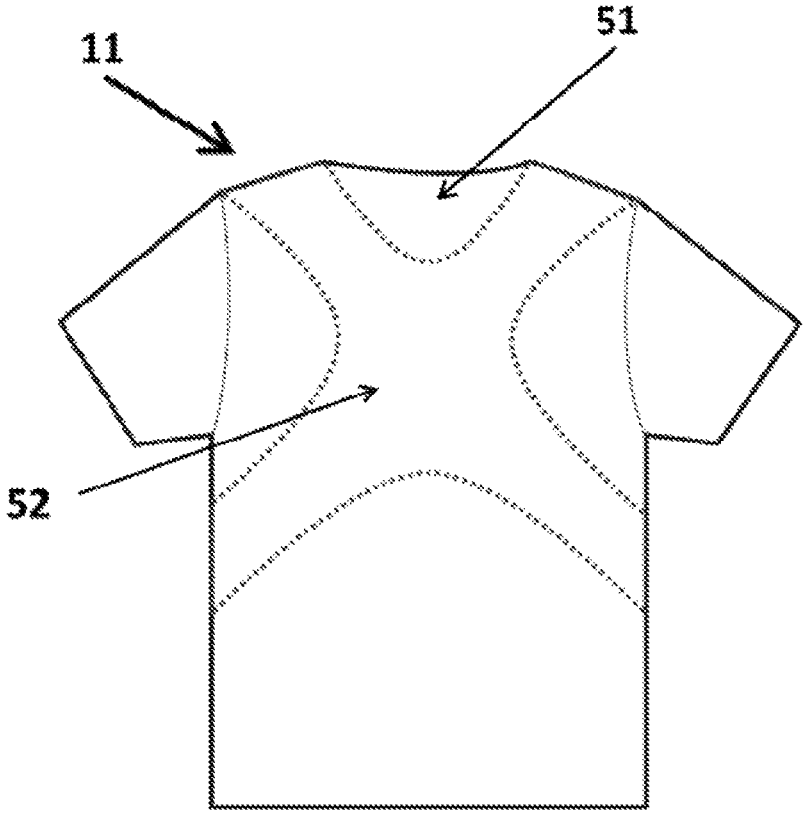

Now in relation to the FIGS. 1 to 6, where a baby carrier T-shirt is shown 11 which enables skin to skin direct and integral contact with the baby and the carrier, comprising a front part 12 and a rear part 51 arranged to form the body of the T-shirt 11; a first vertical strap 13 and a second vertical strap 14 arranged along the front part of the T-shirt 12 and joined to the T-shirt 11 from the area of the shoulders towards the lower end of the T-shirt 11; and a vertical frontal layer 15 also arranged along the front part 12 and below the first and second strap 13, 14; the vertical frontal layer 15 being joined to the T-shirt by the exterior edges of the area of the chest of the T-shirt itself.

The first and the second vertical straps 13, 14 are joined to the T-shirt 11 by means of a lateral seam 16 which is developed along the area of the shoulder and the sleeves of the T-shirt 11 itself; that is to say, the lateral seam has a continuous broken line shape in the form of an L.

The first and second vertical straps 13, 14 have a greater length than the length of the T-shirt 11 itself, being extended further than the lower end of the T-shirt 11.

The vertical frontal layer 15 has a U tongue shape and is also joined to the T-shirt 11 by means of two gathered seams of the exterior edges 31, which are developed from the area of the chest of the body of the T-shirt 11 below and above the underarms of the T-shirt 11 itself; that is to say, above and below the lower joining end of the sleeve to the body of the T-shirt 11.

The lower end of the vertical frontal layer 15 remains free and is folded towards the interior so that there is physical contact between the exterior surface of the frontal vertical layer 15 and the exterior face of the front part 12 of the T-shirt 11 to form an interior seat.

Consequently, the baby is arranged in the seat thus firmed in order to be carried. The baby is carried in a seated position on the interior seat which is in physical contact with the thighs and buttocks of the baby such that the hips oldie baby adopt an M shape in the carrying position.

The height of the interior seat is secured by means of the crossing of the first vertical strap 13 and the second vertical strap 14 below the same; that is to say, the crossing of the first and second vertical straps 13, 14 is arranged to maintain the hips of the carried baby in the M position. The vertical straps 13, 14 are knotted in the rear part 51 of the T-shirt 11.

The rear part 51 comprises a reinforcement device 52 in an X, U shape or similar; the reinforcement device 52 being joined in the area of the shoulders and below the underarms to the rear part 51 of the T-shirt 11. The function of the reinforcement device 52 is to help to maintain the spinal column of the carried baby in a C posture when it is seated in the interior seat.

Alternatively, the vertical frontal layer is removable by at least one upper end so that a removable joining zone is defined at a first outer edge of the upper portion of the T-shirt and at a second outer edge opposite the first edge, by sewing technique forms an outer edge seam, which can be gathered. Both the removable area and the outer edge seam are arranged in the chest area of the T-shirt, below and above the armpits of the carrier, towards the lower end of the T-shirt itself.

The vertical front layer includes a zipper arranged in one of the armpits in the removable joining area of the first outer edge of the upper portion of the shirt. At a free end of the zipper a safety element is arranged to prevent the zipper from accidentally opening.

The invention claimed is:

1. A baby carrier T-shirt comprises a front part which includes a chest area that is proximate to a wearer's chest when the T-shirt is being worn and a rear part arranged to form the body of the T-shirt and a shoulder part; the T-shirt comprising a first vertical strap and a second vertical strap arranged along the front part of the T-shirt and joined the shoulder part of the T-shirt and extending towards the lower end of the T-shirt; and a frontal vertical layer arranged along the front part and below the first and second straps; the frontal vertical layer being joined to the front part of the T-shirt by both vertical ends of the area of the chest of the T-shirt the frontal vertical layer having a free lower end configured to be folded towards the interior and entering into physical contact with the front part of the T-shirt;

and wherein the rear part comprises a reinforcement device in the form of an X, or U shape, the reinforcement device being configured to be joined to the rear part of the T-shirt along the area of the shoulders and below the underarms of the body of the T-shirt and wherein the reinforcement is configured to maintain the spinal column of the baby in a C posture when it is seated on the folded free lower end of the frontal vertical layer.

2. The T-shirt according to claim 1; wherein the frontal vertical layer (15) has a free lower end configured to enable folding of the free lower end towards the interior, the folded lower end entering into physical contact with the front part (12) of the T-shirt (11).

3. The T-shirt according to claim 2, wherein the frontal vertical layer has a rounded shape.

4. The T-shirt according to claim 2, wherein the first vertical strap and the second vertical strap are configured to be crossed below the interior seat formed and tied along the rear part of the T-shirt.

5. The T-shirt according to claim 1, wherein the first vertical strap and the second vertical strap are configured to be joined to the T-shirt by a lateral seam, respectively, which is developed along the area of the shoulder and sleeves of the T-shirt.

6. The T-shirt according to claim 1, wherein the frontal vertical layer is configured to be joined to the T-shirt by sewing, forming two seams of exterior edges, which are developed from the area of the chest of the T-shirt below and above the underarms of the body of the T-shirt.

* * * * *